US008523814B2

(12) United States Patent
Finke

(10) Patent No.: US 8,523,814 B2
(45) Date of Patent: Sep. 3, 2013

(54) SELF-VENTING CANNULA ASSEMBLY

(75) Inventor: Mel Finke, Deland, FL (US)

(73) Assignee: Covidien LP, Mansfield, MA (US)

( * ) Notice: Subject to any disclaimer, the term of this patent is extended or adjusted under 35 U.S.C. 154(b) by 164 days.

(21) Appl. No.: 12/891,885

(22) Filed: Sep. 28, 2010

(65) Prior Publication Data

US 2012/0078179 A1 Mar. 29, 2012

(51) Int. Cl.
*A61M 1/00* (2006.01)
*A61M 5/32* (2006.01)

(52) U.S. Cl.
USPC ..... 604/125; 604/124; 604/411

(58) Field of Classification Search
USPC ..... 604/82, 405, 406, 84–92, 122–127, 604/411–414, 167.01–167.06, 168.01, 415, 604/519, 232
See application file for complete search history.

(56) References Cited

U.S. PATENT DOCUMENTS

| | | | | |
|---|---|---|---|---|
| 4,096,860 | A | 6/1978 | McLaughlin | |
| 4,537,593 | A | 8/1985 | Alchas | |
| 4,607,671 | A | 8/1986 | Aalto et al. | |
| 4,610,683 | A | 9/1986 | Vaillancourt | |
| 4,619,651 | A | 10/1986 | Kopfer et al. | |
| 4,723,955 | A | 2/1988 | Vaillancourt | |
| 4,743,243 | A | 5/1988 | Vaillancourt | |
| 4,768,568 | A * | 9/1988 | Fournier et al. | 141/286 |
| 4,787,898 | A | 11/1988 | Raines | |
| 4,979,941 | A | 12/1990 | Ogle, II | |
| 5,226,900 | A | 7/1993 | Bancsi et al. | |
| 6,090,091 | A | 7/2000 | Fowles et al. | |
| 6,645,171 | B1 | 11/2003 | Robinson et al. | |
| 6,673,035 | B1 | 1/2004 | Rice et al. | |
| 6,948,522 | B2 | 9/2005 | Newbrough et al. | |
| 7,425,209 | B2 | 9/2008 | Fowles et al. | |
| 2002/0068896 | A1 | 6/2002 | Robinson et al. | |
| 2002/0193777 | A1 * | 12/2002 | Aneas | 604/411 |
| 2004/0188280 | A1 | 9/2004 | Young | |
| 2006/1011664 | | 6/2006 | Norton | |
| 2007/0088252 | A1 * | 4/2007 | Pestotnik et al. | 604/82 |
| 2010/0030181 | A1 | 2/2010 | Helle et al. | |

FOREIGN PATENT DOCUMENTS

DE 202 11 355 10/2002

OTHER PUBLICATIONS

International Search Report dated Jan. 31, 2012 in related International Application No. PCT/US2011/053214.

* cited by examiner

*Primary Examiner* — Theodore J Stigell
*Assistant Examiner* — Weng Lee
(74) *Attorney, Agent, or Firm* — Lisa E. Winsor, Esq.

(57) ABSTRACT

The present disclosure relates to a self-venting cannula assembly. The self-venting cannula assembly including an outer tube that defines a throughbore, an inner tube, a vent aperture, and a filter element. The inner tube is positioned within the outer tube, which defines a vent channel therebetween. The vent aperture is formed in the outer tube to provide fluid communication between the vent channel and an external environment. The filter element is positioned over the vent aperture and prevents particles having a dimension greater than about 0.2 microns from passing therethrough.

10 Claims, 4 Drawing Sheets

SELF-VENTING CANNULA ASSEMBLY

BACKGROUND

1. Technical Field

The present disclosure relates to a self-venting cannula assembly. More particularly, the present disclosure relates to a self-venting cannula assembly including a filter element.

2. Background

Liquid medications for injection and intravenous applications are commonly available in rigid containers sealed with an elastomeric septum. Typically, the amount of liquid medication in these containers is in excess of the amount required for an individual dose. It is therefore often necessary for a medical professional to transfer the liquid medication from one container to another, such as I.V. bottles or to other storage or delivery devices such as syringes. Transfer of liquid medication from one container to another is also common in instances in which the medication has a short shelf life and reconstituted or mixed with a diluents just prior administration to a patient. The diluent may be for example a dextrose solution, a saline solution or even water. Transfer of liquid medication to and from these vials involves piercing the septum to provide a path for the medication and also to provide a path for air to escape or enter the vial so that the medication will flow freely. In order to maintain a pressure equilibrium, during the extraction of a liquid medication from a vial ambient air may to enter the vial, while during the addition of a liquid to dilute or reconstitute a medication pressurized air within the vial is released.

In the medical field, various types of medicinal fluids are reconstituted or mixed with a diluent before being delivered intravenously to a patient. With the use of commonly known delivery devices (e.g., a syringe and a vented cannula assembly), the diluent is injected into a vial containing the medicinal fluid or vice versa. Afterwards, the vial containing the mixed solution (e.g., the medicinal fluid and the diluent) is shaken to mix the medicinal fluid with the diluent. This type of fluid transfer may be repeated several times until proper mixing has been accomplished.

During reconstitution, the air within a closed medicinal vial or a closed diluent vial becomes pressurized due to the addition of fluid into the closed vial. The pressurized air is typically vented through a vent channel within a vented cannula, which is used to inject the fluid from one vial into the other vial. When this occurs, aerosolized contaminants of the medicinal fluid (e.g., chemotherapy drugs) may be vented from the vented cannula and into the air surrounding a user. Exposure to such aerosolized contaminants may be harmful to the user preparing such medicinal solutions. Accordingly, a continuing need exists in the art for a vented cannula assembly which prevents aerosolized contaminants from being expelled from a vial during reconstitution or a like procedure.

Similarly, during repeated extraction of a medication from a single vial, ambient air enters the vial and may contaminate the contents of the vial. Accordingly, it is desirable to filter ambient air prior to entering the vial.

SUMMARY

The present disclosure relates to a self-venting cannula assembly. The self-venting cannula assembly includes an outer tube that defines a throughbore, an inner tube, a vent aperture, and a filter element. The inner tube is positioned within the outer tube, which defines a vent channel therebetween. The vent aperture is formed in the outer tube to provide fluid communication between the vent channel and an external environment. The filter element is positioned over the vent aperture and prevents particles having a dimension greater than about 0.2 microns from passing therethrough.

In embodiments, the self-venting cannula assembly may include a hub portion having a proximal open end. The hub portion is adapted to engage a medical injection device, e.g., a vial having a pierceable septum. The inner tube may include a proximal end configured to pierce a septum of a medical vial.

In other embodiments, a distal portion of the hub portion may be coupled to a proximal portion of the outer tube. The outer tube and the hub portion may be integrally formed, e.g., by an injection molding process.

In embodiments, the filter element may include a tapered body portion that is configured and dimensioned to engage a corresponding shoulder defined within the outer tube to support the filter element within the outer tube. Additionally, the filter element may be positioned between the outer tube and the inner tube.

BRIEF DESCRIPTION OF THE DRAWINGS

Various embodiments of the subject cannula assembly are described herein with reference to the drawings wherein.

DETAILED DESCRIPTION

Figure 1:
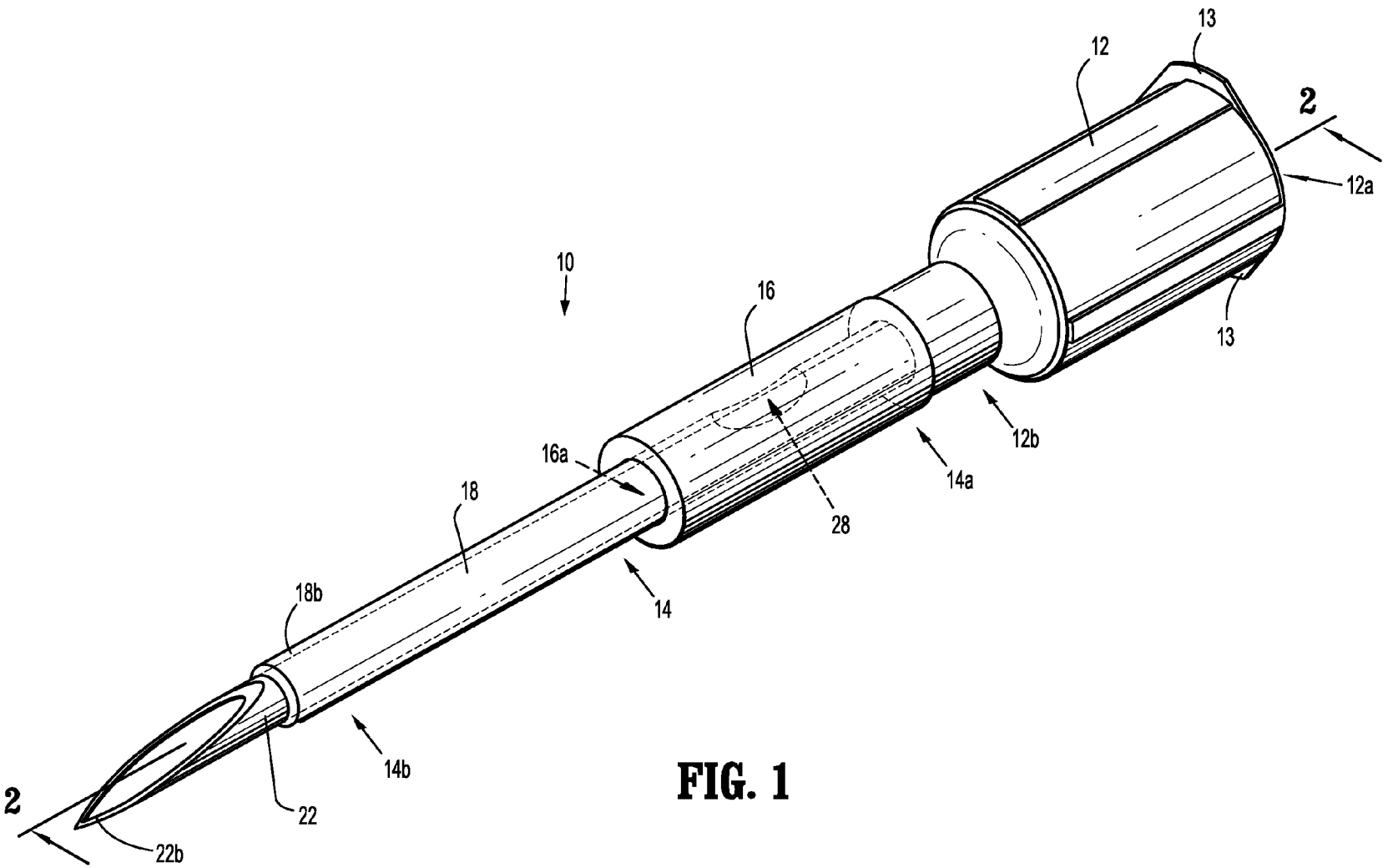
FIG. 1 is a perspective view of a self-venting cannula assembly according to one embodiment of the present disclosure.

Embodiments of the presently disclosed self-venting cannula assembly are described in detail with reference to the drawings wherein like reference numerals identify similar or identical elements. As used herein, the term "distal" refers to that portion of the device which is further from a user while the term "proximal" refers to that portion of the device which is closer to a user. As used herein, the phrase "external environment" refers to an area outside the device.

The present disclosure is directed to a self-venting cannula assembly that is configured to regulate and filter air pressure within a sealed vial or container by either allowing external air to enter the vial or to allow pressurized air within the vial to escape. In the presently disclosed embodiments, a filter element is positioned over a vent aperture such that submicron elements (e.g., elements greater than 0.2 microns) are prevented from being expelled through the vent by the filter element. Alternatively, filters having porosities of less than 0.2 microns are also envisioned.

Figure 2:
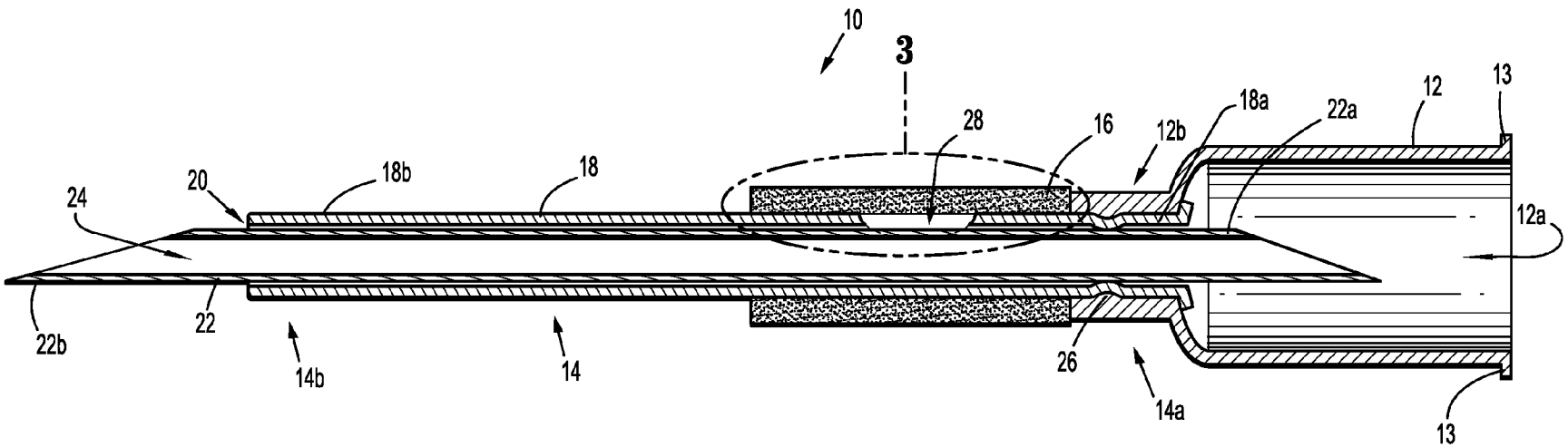
FIG. 2 is a side cross-sectional view of the self-venting cannula assembly of FIG. 1.

Referring to FIGS. 1 and 2, a self-venting cannula assembly according to the present disclosure is shown generally as 10. Self-venting cannula assembly 10 includes a hub portion 12, a vented cannula assembly 14 and a filter element 16.

Hub portion 12 includes an open proximal end 12*a* and an open distal end 12*b* that is fluidly coupled to a vented cannula assembly 14 by any suitable known attaching technique, including, but not limited to crimping, friction-fitting, or adhesive attachment. Open proximal end 12*a* is adapted to couple to a sealed vial including a pierceable septum (not shown) or any other suitable type of medical device. Flub portion 12 further includes finger tabs 13 that are positioned around a periphery of open proximal end 12*a*. Finger tabs 13 allow a user to firmly engage or disengage a vial (not shown) to or from hub portion 12.

Vented cannula assembly 14 includes an outer tube 18 and an inner tube 22, which may be made from stainless steel or any other suitable material, e.g., polymeric materials, etc. Outer tube 18 includes a proximal portion 18*a* and distal portion 18*b*. Proximal portion 18*a* of outer tube 18 is coupled to open distal end 12*b* of hub portion 12 using, for example, adhesives, welding, crimping or other suitable coupling techniques. Distal portion 18*b* of outer tube 18 may have a blunt configuration to prevent coring when vented cannula assembly 14 is inserted within a pierceable septum of a vial (not shown).

Figure 5:
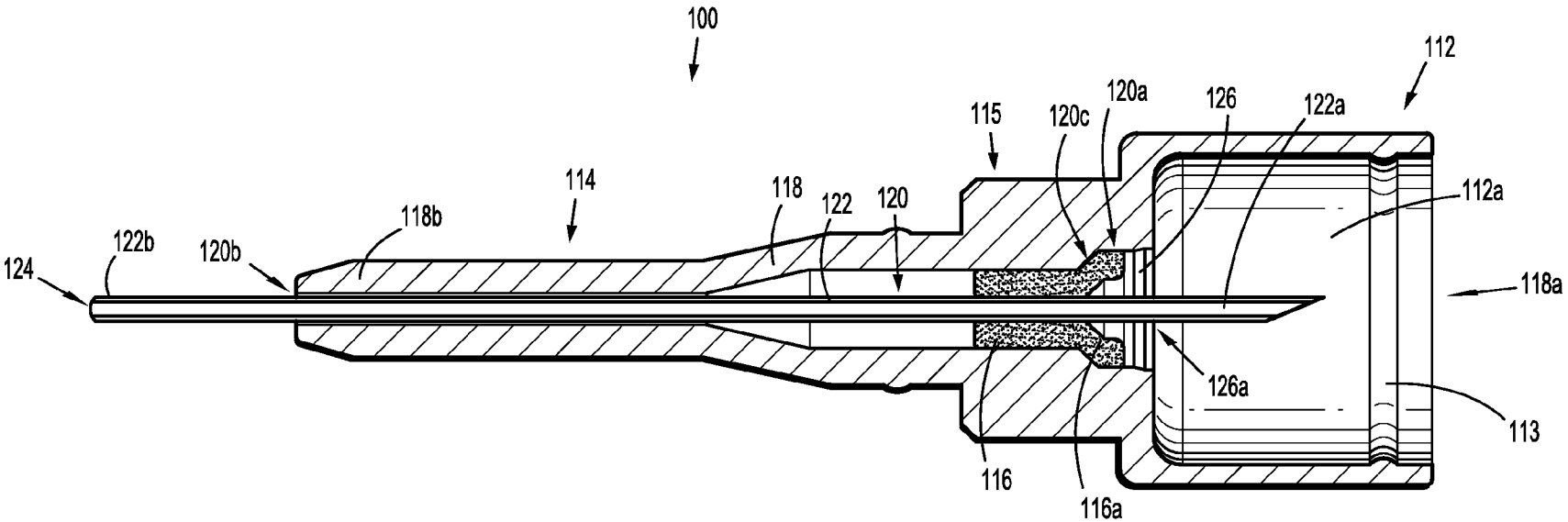
FIG. 5 is a side cross-sectional view of the self-venting cannula assembly of FIG. 4.

Referring still to FIG. 2, inner tube 22 includes a proximal portion 22*a* and distal portion 22*b* and defines a throughbore 24 therebetween that is configured to allow any suitable substance (e.g., liquid, solid and gas) to pass therethrough. Proximal portion 22*a* of inner tube 22 includes a sharp tapered edge that is configured to penetrate a pierceable septum of a vial (not shown). Distal portion 22*b* of inner tube 22 includes a sharp tapered edge that is configured to penetrate a pierceable septum of a vial (not shown). Alternatively, distal portion 22*b* may have a blunt tip configuration, as shown in FIG. 5.

It is envisioned that hub portion 12 may be constructed to include a luer-type connector configured to engage a medical syringe rather than a medical vial having a pierceable septum. In such a device, proximal portion 22*a* of inner tube 22 need not be sharpened or project into hub portion 12.

Outer tube 18 is configured and dimensioned to receive inner tube 22 such that a vent channel 20 is defined between outer tube 18 and inner tube 22, as shown in FIG. 2. In the embodiment shown, the inner diameter of outer tube 18 is larger than the outer diameter of inner tube 22 to define a substantially annular vent channel 20. Alternatively, the vent channel need not be substantially annular, but rather, may have a variety of configurations including linear. In one embodiment, the outer tube 18 may have an inner diameter having an irregular cross sectional area creating a passageway between the outer diameter of the inner tube such that the outer diameter of the inner tube contacts substantially all of the inner diameter of the outer tube, leaving one or more channels between the inner and outer tubes. Inner tube 22 is securely coupled within outer tube 18 by one or more crimps 26 at any suitable portion along the longitudinal length of outer tube 18. Alternatively, inner tube 22 may be securely coupled to outer tube 18 by using adhesives, welding or other suitable means. Outer tube 18 further includes a vent aperture 28 that extends through the outer tube 18 and communicates with vent channel 20. Vent aperture 28 allows vent channel 20 to fluidly communicate with an external environment.

Figure 3:
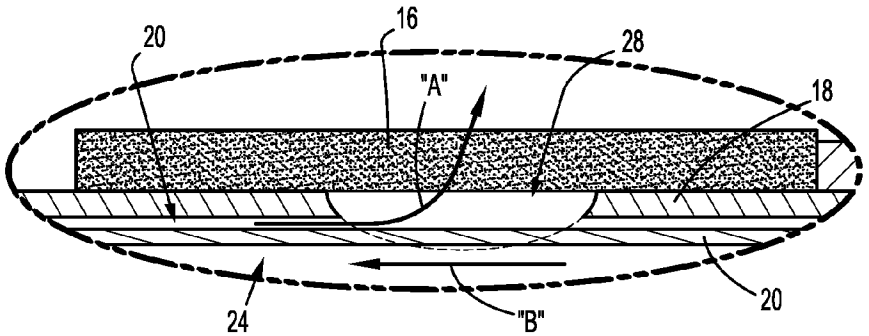
FIG. 3 is an enlarged view of an area of detail of FIG. 2.

Referring to FIGS. 1-3, filter element 16 is disposed over a vent aperture 28 of outer tube 18. In the embodiment shown in FIGS. 1-3 the filter element 16 may be positioned around outer tube 18 of vented cannula assembly 14. More specifically, filter element 16 is positioned around vent aperture 24 of outer tube 18. Filter element 16 may be a sub-micron filter that is manufactured by POREX® and is configured to trap (e.g., filter) any solid and/or liquid particles (e.g., greater than 0.2 microns) that are expelled from vent channel 20 through vent aperture 28. In this configuration, contaminants or other solid matter that travel in the air flowing into or out of filter element 16, as depicted by directional arrow "A", will be trapped by filter element 16.

Aperture 28 may have any size and configuration suitable for a particular application, such as expected pressure. For example, aperture 28 may be circular, oblong, square, rectangular, trapezoidal or of an irregular cross sectional area. The sidewalls through outer tube 18 of aperture 28 may be substantially perpendicular, angled, convex, concave, and combinations thereof. In the embodiment shown in FIG. 3, the sidewalls of aperture 28 are concave.

In use, when a fluid (e.g., medicine) is injected from a syringe or vial (not shown) via throughbore 24 of inner tube 22 into a second vial (not shown) for reconstitution, as depicted by directional arrow "B," air from the second vial will flow into vent channel 20, through vent aperture 28 and filter element 16, and into the external environment. In this manner, any aerosolized contaminants or other solid or fluid matter that may escape from within the second vial via vent channel 20 will be substantially trapped by filter element 16 to protect a user from being exposed to the aerosolized contaminants. When fluid is extracted from the vial through bore 24 of inner tube 22, air from the external environment may be drawn through filter element 16, through vent aperture 28, through channel 20 and into the vial.

In an alternative embodiment, not shown, the self venting cannula assembly may be similar to that shown in FIGS. 1-3 except the inner tube 22 may be a single tipped cannula, for example the needle of a syringe. Inner tube 22 may be removably or permanently staked to a needle hub by conventional attachment methods, thus forming a self-venting needle syringe for either introducing a liquid into a vial or removing a liquid medication from a vial.

Figure 4:
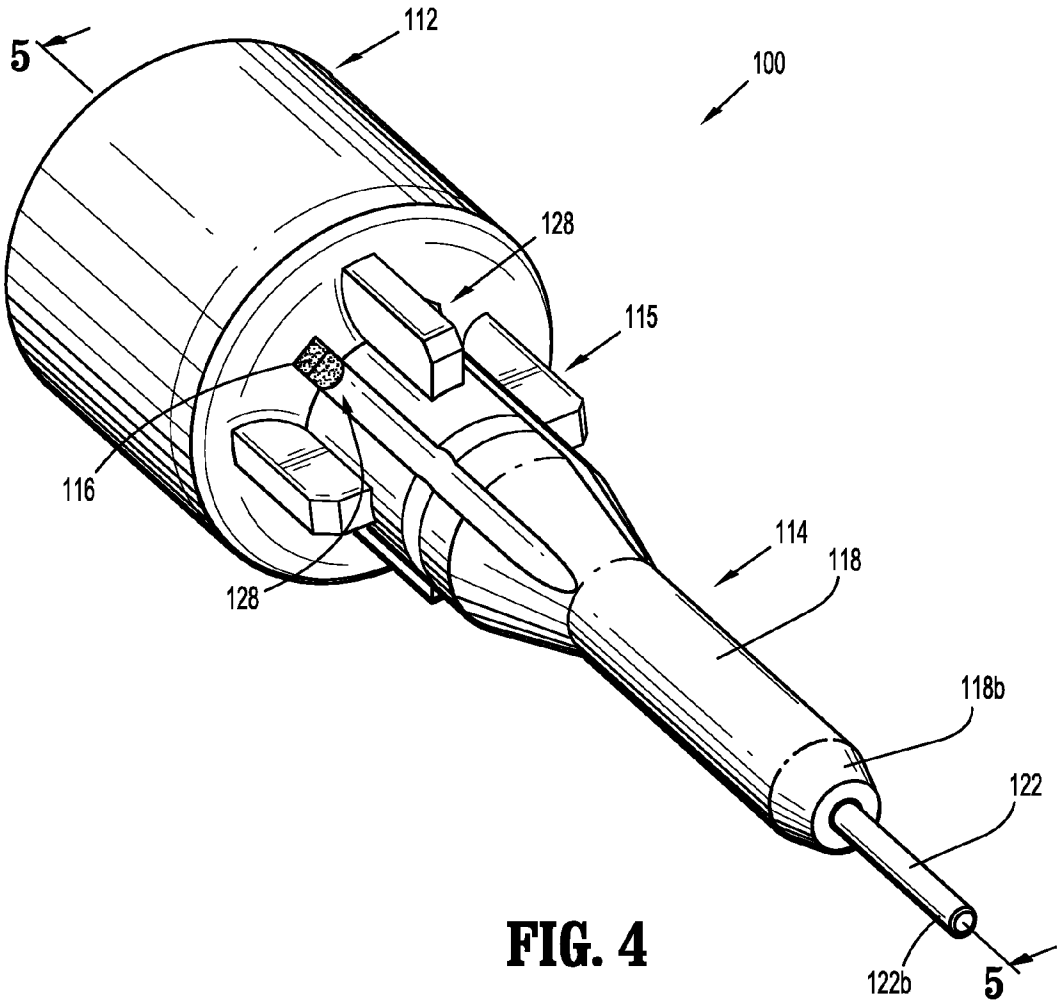
FIG. 4 is a perspective view of a self-venting cannula assembly according to another embodiment of the present disclosure.

In an alternative embodiment, as shown in FIGS. 4 and 5, a self-venting cannula assembly 100 includes an outer tube 118 having a hub portion 112 and vented cannula assembly 114. Outer tube 118 may be formed by an injection molding process or machining process. Outer tube 118 is configured and dimensioned to receive an inner tube 122 such that a vent channel 120 is defined between outer tube 118 and inner tube 122. Outer tube 118 further includes one or more vent apertures 128 that are formed in the outer surface of outer tube 118 about a mid-section 115. Vent apertures 128 fluidly communicate vent channel 120 with an external environment. Inner tube 122 may be made from metal, plastic, or any other suitable piercing material.

Referring to FIG. 5, outer tube 118 includes a proximal hub portion 112 and an open distal portion 118*b* that are in fluid communication via a vent channel 120, as will be described in further detail below. Proximal hub portion 112 includes an open end 118*a* that is configured to receive a vial, a syringe or any other type of medicinal storage and/or delivery device. An inner wall 112*a* of hub portion 112 includes an annular bead 113 to facilitate releasable engagement of a vial and/or syringe. Other types of releasable engagement structures are known and envisioned for use in place of the annular bead. Distal portion 118*b* of outer tube 118 may have a blunt tip configuration to prevent coring of a vial septum (not shown) when vented cannula assembly 114 is inserted through the pierceable septum of a vial (not shown).

Inner tube 122 defines a throughbore 124 and includes a proximal portion 122*a* and distal portion 122*b*. Proximal portion 122*a* of inner tube 122 includes a sharp tapered edge that is configured to penetrate a pierceable septum of a vial (not shown). Distal portion 122*b* of inner tube 122 may have a blunt tip configuration to prevent coring when inserted into a pierceable septum of a vial (not shown). Alternatively, distal portion 122*b* may have a tapered edge configuration (e.g., distal portion 22*b*), as shown in FIG. 1.

Vent channel 120 includes a proximal portion 120*a* and a distal portion 120*b*. At the proximal portion 120*a* of vent channel 120, the inner diameter of outer tube 118 is dimensioned to receive inner tube 122 and a filter element 116. Filter element 116 is positioned around inner tube 122 and within vent channel 120 at mid-section 115. Further, filter element 116 is configured and dimensioned to cover or obstruct vent apertures 128 to trap (e.g., filter) any sub-micron particles, when air travels up vent channel 120 and out through vent apertures 128 or through apertures 128 to channel 120.

Referring still to FIG. 5, a securing element 126 is positioned within an opening of proximal portion 120*a* of vent channel 120. Securing element 126 may be made of plastic, metal, or any other suitable material and includes a central aperture 126*a* that is configured to receive and secure proximal portion 122*a* of inner tube 122 within outer tube 118. It is envisioned that the connection between central aperture 126*a* and inner tube 122 is a substantially sealed connection to prevent venting into hub portion 112. Additionally, securing element 126 is configured to retain filter element 116 within vent channel 120. It is envisioned that filter element 116 and proximal portion 122*a* of inner tube 122 are dimensioned to matingly join one another. In the embodiment shown, filter element 116 includes a tapered body portion 116*a* on one end that is configured and dimensioned to engage a corresponding shoulder 120*c* of vent channel 120 to support filter element 116 within vent channel 120.

In instances in which filtering the transfer of air is not desired, airflow through the filters may be bypassed. For example, a secondary pathway (not shown) between channel 120 and a secondary orifice (not shown) positioned at a location between the channel 120 and the filter element 116. The secondary orifice may include a movable cover or seal (not shown) to allow air to pass through or to prevent air from passing through the second orifice. Alternatively, in instances in which filtering the transfer air is not desired, the filter element may be omitted from the disclosed embodiments.

It will be understood that various modifications may be made to the embodiments disclose herein. For example, the length and the dimensions of the disclosed throughbores of the outer and inner tubes of the disclosed self-venting cannula assembly may vary. Therefore, the above description should not be construed as limiting, but merely as exemplifications of embodiments. Those skilled in the art will envision other modification within the scope and spirit of the claims appended hereto.

What is claimed is:

1. A self-venting cannula assembly comprising:

an outer tube defining a throughbore;

an inner tube positioned within the outer tube and defining a vent channel therebetween;

a vent aperture formed in the outer tube to provide fluid communication between the vent channel and an external environment; and a filter element positioned over the vent aperture, the filter element preventing particles having a dimension greater than about 0.2 microns from passing through the filter element, wherein the filter element includes a tapered body portion that is configured and dimensioned to engage a corresponding shoulder defined within the outer tube to support the filter element within the outer tube.

2. The self-venting cannula assembly according to claim 1, further including a hub portion having a proximal open end, the hub portion being adapted to engage a medical injection device.

3. The self-venting cannula assembly according to claim 2, wherein the medical injection device is a vial having a pierceable septum.

4. The self-venting cannula assembly according to claim 3, wherein the inner tube includes a proximal end configured to pierce a septum of a medical vial.

5. The self-venting cannula assembly according to claim 2, wherein a distal portion of the hub portion is coupled to a proximal portion of the outer tube.

6. The self-venting cannula assembly according to claim 2, wherein the proximal open end of hub portion includes a luer-type connector.

7. The self-venting cannula assembly according to claim 2, wherein the outer tube and the hub portion are integrally formed.

8. The self-venting cannula assembly according to claim 7, wherein the outer tube and the hub portion are integrally formed by an injection molding process.

9. The self-venting cannula assembly according to claim 1, wherein the inner tube is secured within the outer tube by a coupling technique selected from the group consisting of crimping, adhering, and welding.

10. The self-venting cannula assembly according to claim 1, wherein the filter element is positioned between the outer tube and the inner tube.

* * * * *